United States Patent [19]

Jacobs

[11] B 3,998,570

[45] Dec. 21, 1976

[54] AIR CONDITIONING COMPRESSOR

[75] Inventor: James W. Jacobs, Dayton, Ohio

[73] Assignee: General Motors Corporation, Detroit, Mich.

[22] Filed: Apr. 23, 1975

[21] Appl. No.: 570,615

[44] Published under the second Trial Voluntary Protest Program on March 23, 1976 as document No. B 570,615.

[52] U.S. Cl. ..... 417/274; 62/228; 92/60.5

[51] Int. Cl.[2] ..... F04B 49/08

[58] Field of Search ..... 62/228, 196; 417/274; 92/60.5

[56] References Cited

UNITED STATES PATENTS

| | | | |
|---|---|---|---|
| 2,912,833 | 11/1959 | McGrath | 417/274 X |
| 3,618,475 | 11/1971 | Sauder | 417/274 X |

*Primary Examiner*—William E. Wayner
*Attorney, Agent, or Firm*—K. H. MacLean, Jr.

[57] ABSTRACT

A piston type compressor for use in an automotive air conditioning system with variable pumping or compressing capacity which is automatically modulated in response to operating conditions. Compressor improvements are solely to the piston so that the present investment in fixed displacement compressors is not diminished. Previous compressors may be modified by the substitution of the improved pistons to create a variable capacity compressor. Specifically, the piston modifications include a pressure responsive displacement means on the piston end which extends into the compression chamber during portions of the intake stroke and compression stroke to effectively decrease the volumetric pumping capacity of the compressor whenever a predetermined low pressure is sensed.

2 Claims, 2 Drawing Figures

AIR CONDITIONING COMPRESSOR

Figure 1:
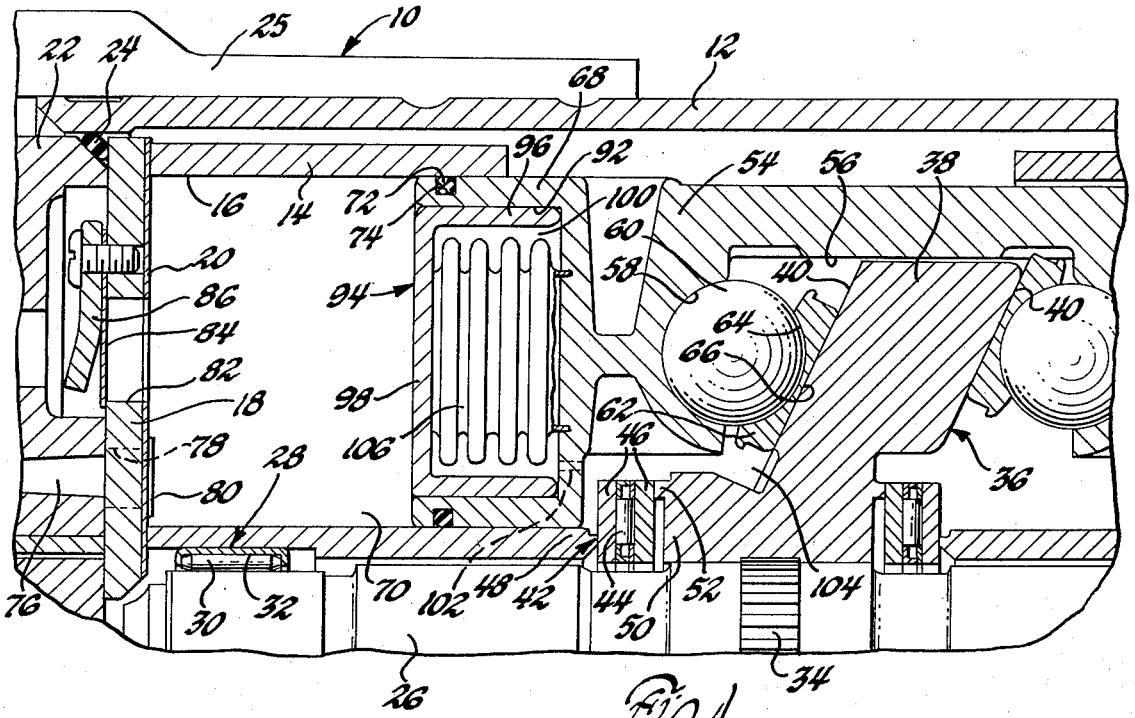

This invention relates to an improved refrigerant compressor for an automotive air conditioning system which will operate economically over a wide range of ambient temperatures due to features which provide automatic modulation of the pumping capacity.

Basically, the subject invention is an improved piston type compressor similar to the presently available compressor disclosed in U.S. Pat. No. 3,057,545 to Ransom which issued Oct. 9, 1962. The Ransom patent discloses a compressor having a plurality of axially aligned cylinder bores arranged about a drive shaft and having dual-ended pistons therein which are reciprocated by engagement with the inclined surface of a swashplate fitted drive shaft. The Ransom compressor is a fixed displacement type without means to vary the pumping capacity in response to the cooling demands on the air conditioning system.

An automotive air conditioning system is expected to operate economically under a wide variety of operating conditions. Specifically, the ambient temperature environment of the air conditioning system may vary. When the ambient temperature is relatively high, say above 90°F., air flowing over the exterior surfaces of the evaporator is relatively warm and thus a large volume of liquid refrigerant may be passed through the evaporator with complete vaporization taking place. The evaporator's pressure is maintained above a level corresponding to freezing temperatures on the exterior surfaces. However, if the temperatures of the exterior surfaces of the evaporator are permitted to fall below 32°F., frost will normally begin to accumulate on the evaporator and if this continues, the air flowing through the evaporator may be entirely blocked.

When the air conditioning system is operated in a relatively low ambient temperature environment, say below 70°F., the decreased heat transfer between air and refrigerant in the evaporator may be less than necessary to vaporize the refrigerant supplied to the evaporator by the compressor. Consequently, the level of liquid refrigerant in the evaporator increases and incomplete evaporation of the liquid refrigerant takes place and this produces relatively low pressures in the evaporator and corresponding low refrigerant temperatures. Low refrigerant temperatures below 32°F. must be avoided to prevent frost accumulation. Commercial automobile air conditioning systems utilize throttling valves in the suction line between the evaporator and compressor to restrict evacuation of the evaporator and thus maintain evaporator pressure above freezing levels. The present invention eliminates the need for a throttling valve by providing automatically modulated means to decrease the compressor's effective displacement or pumping capacity in response to decreasing evaporator pressures.

Presently, the compressor's displacement which directly relates to pumping capacity is designed to provide rapid cooling on a hot day so the temperature of the passenger compartment of the vehicle will be decreased to comfortable levels within a reasonable time. This relatively large pumping capacity is, of course, in excess of the pumping capacity needed when the system is operated at lower ambient temperatures. As previously stated, it exceeds the capacity needed for the reduced heat load on the evaporator at these low ambient temperatures. Therefore, to accommodate operation of the air conditioning system under low ambient temperature conditions yet to still provide sufficiently rapid cooling under high ambient temperature conditions, it is desirable to utilize a variable displacement compressor which automatically decreases the effective displacement and pumping capacity of the compressor when evaporator pressures decrease which correspond to low ambient temperature operation of the air conditioning system.

The disclosed invention provides a simple and compact modification of a compressor to provide automatically modulated displacement for a compressor. The modifications are solely to the pistons themselves so that the advantage of automatic modulation may be utilized in present fixed displacement compressors with the same general piston configuration.

More specifically, the piston modifications include pressure actuated secondary displacement means which extend into the compressor chamber during portions of the intake and compression strokes whenever a predetermined low inlet pressure is sensed. During the remaining portions of the intake and compression stroke, the displacement means withdraw into the piston from the compression chamber to effectively reduce the displacement and pumping capacity of the compressor.

Further advantages and desirable features of the subject modulated compressor will become more apparent from the following detailed description, reference being had to the drawings in which the preferred embodiment of the invention is shown.

Figure 2:
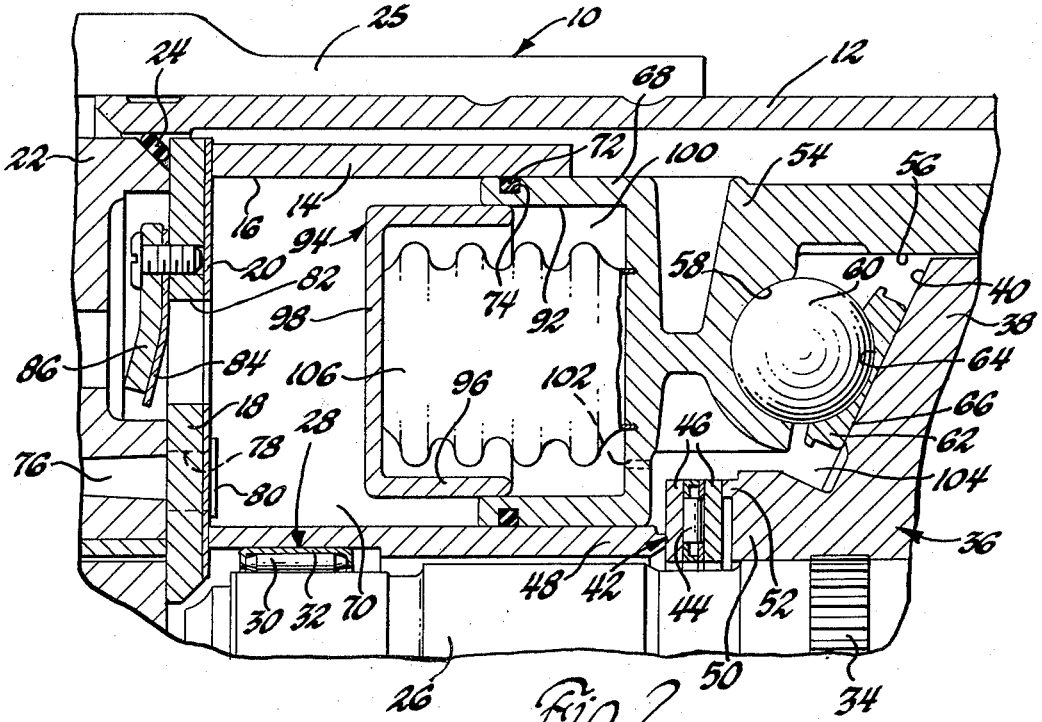

IN THE DRAWINGS:

FIG. 1 is a fragmentary sectioned view of a portion of the improved piston type compressor shown with the piston located at the end of the intake stroke and the beginning of the compression stroke during operation of the air conditioning system in a relatively high ambient temperature environment; and FIG. 2 is a view similar to FIG. 1 but during operation of the air conditioning system in a relatively low ambient temperature environment.

In the drawings, a piston type compressor 10 is disclosed which has a variable displacement capability. Compressor 10 is not completely shown in view of the fact that the improvement in the compressor over the Ransom compressor discussed above is basically an improvement in the piston configuration. Compressor 10 includes an outer cylindrical housing 12 which encircles a cylinder block 14 having at least one cylindrical bore 16 therein. The end of the cylinder block 14 is covered by a valve plate 18 and an intake reed valve plate 20. A cylinder head 22 is secured in the end of housing 12 to position the members 14, 18 and 20 within the housing. An O-ring 24 between the members 12, 18 and 22 prevents refrigerant leakage therebetween from the interior of the housing 10. The cylinder head 22 may be attached to housing 10 by means of fastener strap 25 as is disclosed in the Ransom patent or by welding or brazing.

A drive shaft 26 extends through the housing 10 with one end portion extending through one of the cylinder heads (not visible in the drawings) to the exterior of the compressor 10 where it is adapted to be attached to a pulley assembly which receives a rotative motion from the vehicle engine. The drive shaft 26 is supported by a roller bearing assembly 28. The bearing 28 includes a plurality of needle bearings 30 which are encircled by a raceway 32. At the midportion of the drive shaft 26, an enlarged diameter knurled portion 34 is formed. Encircling the knurled portion 34 is a swashplate 36 including a circular portion 38 having flat surfaces 40 thereon inclined with respect to a plane normal to the axis of the drive shaft 26. A thrust bearing assembly 42 which includes needle bearings 44 and raceways 46 is located between the central portion 48 of cylinder block 14 and a ridge 52 on a hub portion 50 of the swashplate 36.

A portion of the double-ended piston 54 is shown in the drawings and it has a central cutout portion 56 which straddles the circular portion 38 of the swashplate 36. The piston 54 has a spherical socket 58 formed therein in which a spherical bearing 60 is received. The other side of the bearing 60 engages a thrust bearing shoe 62 which has a spherical socket 64 on one side and a flat surface 66 on the other side which engages face 40 of swashplate 36. Rotation of the shaft 26 within the housing 12 causes the circular portion 38 of the swashplate 36 to move the inclined surfaces 40 axially to the right and left and thereby reciprocate piston head 68 within bore 16.

The head portion 68 of piston 54 moves to the left from the position shown in FIG. 1 and then back to the right during a compression and intake stroke. Refrigerant is compressed within compression chamber 70 during this operation. An O-ring 72 in annular groove 74 engages the walls of the cylinder bore 16 to prevent refrigerant leakage between the piston and the cylinder block. When piston 54 is moved to the right toward the position shown in FIGS. 1 and 2 during an intake stroke, refrigerant is drawn from an inlet chamber 76 in head 22 through an inlet port 78 in valve plate 18 into the compression chamber. Refrigerant flows through the inlet into the compression chamber 70 and the flow is controlled by inward flexing of a finger-shaped inlet valve portion 80 on the inlet reed plate 20 in response to a differential pressure between the compression chamber 70 and the inlet passage 76. When the piston moves to the left in bore 16, the refrigerant is compressed and resultantly passes through an outlet port 82 and past a flexible finger-like outlet valve 84 whose outward flexing is limited by a backup member 86.

The aforedescribed operation of the compressor 10 is in accordance with desirable performance characteristics when the air conditioning system is operating in a relatively high ambient temperature environment (i.e., above 90°F.). During operation of the air conditioning system in a relatively low ambient temperature environment (i.e., below 70°F.), full displacement and maximum pumping of the compressor 10 is unnecessary and as previously stated will often cause an undesirable quantity of liquid refrigerant to collect in the evaporator and thereby lower its pressure and temperature below freezing. Therefore, the present invention utilizes a modified piston which has a recess 92 formed within head 68. A modulating displacement piston 94 is supported for reciprocation within the recess 92 and has a cylindrical annular side wall 96 and a face or end portion 98. The piston 94 and piston head 68 defines a first enclosure 100 which is fluidly connected by a bleed passage 102 to the sump region 104 of the compressor which itself communicates with the input of the compressor. The inlet and the enclosure 100 are low pressure portions of the compressor. Located within the space between sides 96 of the modulating piston 94 and the head 68 of piston 54, is a bellows 106. One end of the bellows 106 is attached to the end 98 of piston 94 and the other end of bellows 106 is attached to head 68. The interior of bellows 106 forms a second enclosure which is filled with a fluid such as nitrogen characterized by relatively limited volumetric and pressure changes with changes in temperature.

During operation of the air conditioning system in a relatively high ambient temperature environment, the pressure of refrigerant in the compression chamber 70 even at the end of an inlet stroke is great enough to maintain the modulating piston 94 within recess 92 as shown in FIG. 1. However, when the air conditioning system is operated in a relatively low ambient temperature environment, the pressure in the compression chamber 70 during an intake stroke will likely decrease to cause the excess pressure of fluid in bellows 106 to move the modulating piston 94 outward from head 68 into the position shown in FIG. 2. The outwardly extending position of the modulating piston 94 is maintained until piston 54 is moved far enough to the left during a compression stroke to exert pressure on face 98 to overcome the force of the fluid within bellows 106. When the pressure in chamber 70 is greater, the modulating piston 94 is moved to the right in FIG. 2 to the withdrawn position within recess 92. Refrigerant trapped between the modulating piston 94 and the head 68 is permitted to escape through the bleed port 102 in the piston.

The projection of the modulating piston 94 within the compression chamber 70 during portions of the intake and compression strokes effectively reduces the displacement of the compressor and also its pumping capacity in response to the inlet pressure. As previously explained, this is desirable to prevent excess pumping of liquid refrigerant into the evaporator which lowers the pressure and corresponding temperature perhaps below a freezing level.

Although the embodiment illustrated is preferred to achieve the results and advantages pointed out earlier in the specification, it is to be understood that modifications may be made which will not fall outside the scope of the invention as defined in the following claims.

What is claimed is as follows:

1. A piston type compressor for use in an automotive air conditioning system comprising: a housing having at least one cylinder bore therein and including an end portion overlying the cylinder bore; a first piston supported for reciprocal movement within said cylinder bore and forming in conjunction with said cylinder bore and said end portion a variable volume compression chamber for compressing refrigerant therein; said housing defining a valved inlet to said compression chamber and a valved outlet therefrom to control the flow of refrigerant into and from the compression chamber during an intake stroke and a compression stroke respectively; said first piston having a recess formed therein adjacent said compression chamber; a second piston supported for reciprocal movement in said recess and movable with respect to said first piston so as to extend into said compression chamber and to displace refrigerant therefrom; an axially extendible and contractible bellows located between said pistons and forming a sealed enclosure filled with a compressible fluid whereby movement of said bellows controls the extension and contraction of said second piston and exerts a force on said second position tending to cause it to extend into said compression chamber when the pressure force acting on said second piston from refrigerant within said compression chamber is less than the internal force on said bellows exerted by said fluid.

2. A piston type compressor for use in an automotive air conditioning system comprising: a housing having at least one cylinder bore therein and including an end portion overlying the cylinder bore; a first piston supported for reciprocal movement within said cylinder bore and forming in conjunction with said cylinder bore and said end portion a variable volume compression chamber for compressing refrigerant therein; said housing defining a valved inlet to said compression chamber and a valved outlet therefrom to control the flow of refrigerant into and from the compression chamber during an intake and a compression stroke respectively; said first piston having a recess formed therein adjacent said compression chamber; a second piston of generally cup-shaped configuration having an annular side wall slideably engaging the wall portions of said piston which form said recess so as to permit said second piston to reciprocate within the recess and thereby move a face portion into and out of said compression chamber whereby refrigerant in said compression chamber is displaced by said second piston; an axially extendible and contractible bellows located between said pistons and forming a sealed enclosure filled with a compressible fluid whereby axial extension and contraction of said bellows is caused by changes in refrigerant pressure in the compression chamber which produces a force on said second piston and bellows which tends to move the second piston further into said recess when the force produced by the pressure within the compression chamber is greater than the internal pressure force on the bellows exerted by said compressible fluid and which tends to move the second piston away from said first piston and into said compression chamber when the force produced by the pressure within the compression chamber is less than the internal force on the bellows exerted by said compressible fluid outward from said first piston into said compression chamber during a portion of the intake and compression stroke whereby the displacement of the second piston in an outward position effectively decreases the displacement of the compressor defined by movement of said first piston and the pumping capacity of the compressor.

* * * * *